US005353943A

United States Patent [19]

Hayward

[11] Patent Number: 5,353,943

[45] Date of Patent: Oct. 11, 1994

[54] EASY-OPENING COMPOSITE CLOSURE FOR HERMETIC SEALING OF A PACKAGING CONTAINER BY DOUBLE SEAMING

[75] Inventor: Donald W. Hayward, Waterville, Ohio

[73] Assignee: Sonoco Products Company, Hartsville, S.C.

[21] Appl. No.: 31,804

[22] Filed: Mar. 15, 1993

[51] Int. Cl.[5] ..... B65D 17/40

[52] U.S. Cl. ..... 220/276; 220/359; 220/258

[58] Field of Search ..... 220/359, 319, 266, 220, 220/226, 270, 258; 229/125, 235

[56] References Cited

U.S. PATENT DOCUMENTS

| | | |
|---|---|---|
| 2,122,537 | 7/1938 | Pfeffer, Jr. . |
| 2,858,060 | 10/1958 | Küchler . |
| 3,108,708 | 10/1963 | Betner . |
| 3,256,981 | 6/1966 | Kurtz . |
| 3,276,616 | 10/1966 | Lurie . |
| 3,318,477 | 5/1967 | Southwick, Jr. et al. . |
| 3,335,939 | 8/1967 | Robinson, Jr. . |
| 3,402,873 | 9/1968 | Lauterbach, Jr. . |
| 3,483,964 | 12/1969 | Muehling et al. . |
| 3,515,334 | 6/1970 | Jacobson . |
| 3,572,579 | 3/1971 | Mueller et al. . |
| 3,765,561 | 10/1973 | Hekal et al. . |
| 3,832,963 | 9/1974 | Gayner et al. . |
| 3,868,919 | 3/1975 | Schrecker et al. . |
| 3,997,677 | 12/1976 | Hirsch et al. . |
| 4,045,860 | 9/1977 | Winckler . |
| 4,091,930 | 5/1978 | Buchner et al. . |
| 4,207,989 | 6/1980 | Ingemann . |
| 4,280,653 | 7/1981 | Elias . |
| 4,350,263 | 9/1982 | Hoffman . |
| 4,351,473 | 9/1982 | Manizza . |
| 4,359,852 | 11/1982 | Hoffman et al. . |
| 4,363,582 | 12/1982 | Bloeck et al. . |
| 4,433,793 | 2/1984 | Ingemann . |
| 4,448,324 | 5/1984 | Jeppsson et al. . |
| 4,529,100 | 7/1985 | Ingemann . |
| 4,533,576 | 8/1985 | Tanahashi et al. . |

(List continued on next page.)

FOREIGN PATENT DOCUMENTS

| | | |
|---|---|---|
| 0001250 | 4/1979 | European Pat. Off. . |
| 0138267 | 4/1985 | European Pat. Off. . |
| 0312302 | 4/1989 | European Pat. Off. . |
| 0312311 | 4/1989 | European Pat. Off. . |
| 2001032 | 7/1970 | Fed. Rep. of Germany . |
| 53-148742 | 11/1978 | Japan . |
| 55-99838 | 7/1980 | Japan . |
| 56-138075 | 10/1981 | Japan . |

*Primary Examiner*—Joseph Man-Fu Moy
*Attorney, Agent, or Firm*—Bell Seltzer Park

[57] ABSTRACT

An easy-opening closure for hermetic sealing of the open end of a packaging container includes an end member for being double-seamed to the open end of the container and having an interior ledge portion defining a large central opening and a composite lidding member of at least two polymer layers defining a predetermined peel strength at an interfacial plane for controlled delamination of the two layers. The composite lidding member covers the central opening and is bonded to the ledge portion to define a bond strength greater than the peel strength of the two polymer layers. The lidding member has a continuous ring-shaped notch cut into the bottom polymer layer adjacent the ledge portion and a discontinuous ring-shaped notch cut into the top polymer layer and spaced inwardly from the first notch to define a small unnotched portion between its ends and to define with the first notch a ring member therebetween which is connected at the unnotched portion to the central portion of the lidding member. With this construction, the force required to open the closure from the inside of the container is greater than the force required to open the closure from the outside of the container. The closure is circumferentially opened by upward pulling of the bonded overlapping portion of the composite lidding member to cause delamination and peeling of the top polymer layer from the bottom polymer layer bonded to the end member in an area between the first notch and an outside circumference of the lidding member and removal of the ring member between the first and second notches.

10 Claims, 4 Drawing Sheets

U.S. PATENT DOCUMENTS 4,540,105 9/1985 Wright .
4,544,080 10/1985 Wright et al. .
4,544,093 10/1985 Stark et al. .
4,548,333 10/1985 Bobayashi et al. ..... 220/276
4,555,056 11/1985 Bernhardt .
4,556,152 12/1985 Bogren .
4,586,624 5/1986 Shaw .
4,589,568 5/1986 Ito et al. .
4,626,157 12/1986 Franek et al. .
4,636,273 1/1987 Wolfersperger .
4,643,329 2/1987 Mobberley et al. ..... 220/276
4,674,649 6/1987 Pavely .
4,689,099 8/1987 Ito et al. .
4,693,390 9/1987 Hekal .
4,693,391 9/1987 Roth .
4,801,041 1/1989 Takata et al. .
4,810,541 3/1989 Newman et al. .
4,858,780 8/1989 Odaka et al. .
4,865,217 9/1989 Yoshimoto .
4,889,731 12/1989 Williams, Jr. .
4,890,759 1/1990 Scanga et al. .
4,905,838 3/1990 Suzuki et al. .
4,913,307 4/1990 Takata et al. .
5,054,642 10/1991 Yoshida .
5,069,355 12/1991 Matuszak .
5,240,133 8/1933 Thomas, Jr. ..... 220/276

(PRIOR DESIGN)

EASY-OPENING COMPOSITE CLOSURE FOR HERMETIC SEALING OF A PACKAGING CONTAINER BY DOUBLE SEAMING

FIELD OF THE INVENTION

This invention relates to an easy-opening closure for hermetic sealing of the open end of a packaging container. The closure can be formed on conventional end making equipment from composite sheet material and can be joined to the open end of a packaging container using conventional double-seaming equipment.

BACKGROUND OF THE INVESTIGATION

Present commercial operations for hermetically sealing open-ended packaging containers, especially food containers, generally employ either (1) a conventional metallic end, with or without an easy-opening feature, which is double-seamed to a flange on the container, or (2) a film or foil lidding structure, which is attached by adhesive, thermal or other bonding means to a flange on the open end of the container.

With the increasing demand for convenience packaging and ready-to-eat food products, a growing need exists for shelf-stable microwavable food packages. A significant number of these are semi-rigid plastic packaging containers. Food packages for these applications are generally required to undergo a retort/sterilization process to insure that the product is sterile and safe for consumption. Because of the high temperatures and internal pressures associated with the retort process, it is an extremely critical part of the packaging operation to provide a packaging container and closure therefor which have great strength and integrity.

Conventional double-seamed metal ends or closures employed to seal these containers provide seal integrity throughout the retort process, and can provide a convenient easy-open feature for the consumer. The metal end, however, is not entirely appropriate for a package designed to be reheated in a microwave oven, due to arcing and localized heating which can occur during heating. The metal end is also generally not suitable for very wide containers, such as bowls or trays, for a variety of reasons, including the high cost of such an end, and the aesthetically negative appearance of such a package. Additionally, the metal end cannot be used at all in those instances where the heating method of retort comes from microwave energy, due to the very large metallic surface areas which would reflect energy and defeat the ability of the microwave energy to heat the package contents. Ready-to-eat packages which employ a metal end often have a sharp metal edge exposed after removal of the easy-open lid, which presents a possible consumer safety hazard.

Film or foil lidding systems as applied to retortable packages are the most sensitive materials used in the thermal processing. The adhesive or heat-sealed bond between the body of the packaging container and the lidding material is very fragile during the heat processing period. The bond strength can be reduced by as much as 80% at elevated temperatures. Pressures inside the sealed container can rise dramatically during heating, caused by expansion of the product and gases, which place further demands on the sealing area. An additional challenge to the processor is that many of the film/foil lidding systems are designed to have peelable seals to allow for easy opening. An improved type of flexible lidding systems is disclosed, for example, in U.S.

Pat. Nos. 4,801,041; 4,858,780; 4,905,838 and 4,913,307, assigned to Idemitsu Petrochemical Co., Ltd. and commercialized as "MAGICTOP" and which overcomes some of the problems with prior flexible lidding systems. However, all of these flexible lidding systems are attached by bonding to the open end of the container and most processors who employ these types of flexible lidding system must perform extensive testing of seal integrity, including 100% inspection, and require very tight controls on retort conditions to insure against seal failure and/or spoilage of contents.

An improved flexible lidding system in the form of an easy-opening closure for hermetic sealing of an open end of a packaging container has been disclosed in U.S. Pat. No. 5,069,355 and is disclosed in pending U.S. Patent application, Ser. No. 07/684,161 and filed Apr. 11, 1991, both of which are assigned to the assignee of the present invention. In this issued patent and the pending application, a composite end member and a composite lidding member, respectively, are disclosed which respectively utilize two polymer layers defining a predetermined peel strength at an interfacial plane thereof for controlled delamination of the two layers. The end member is of desired construction for being double-seamed to the open end of the container and has an interior ledge defining a large central opening to allow access therethrough to the interior of the container. The lidding member is of desired configuration for covering the central opening and has a portion overlapping the ledge portion and is bonded to the ledge portion to define a predetermined bond strength greater than the peel strength of the two polymer layers. The closure is easily opened by upward pulling of the bonded overlapping portion of the lidding member to cause delamination and peeling of the top polymer layer of the composite end member bonded to the lidding member from the bottom polymer layer in the closure construction of U.S. Pat. No. 5,069,355 and to cause delamination and peeling of the portion of the top polymer layer from the bottom polymer layer in the composite lidding member bonded to the end member in pending U.S. Patent application Ser. No. 07/684,161. In both of these systems, although the peel strength of the two polymer layers of the respective lidding member or end member are greater than the bond strength of that member to the other of the members, the force required to open the container is not consistent since the containers are opened linearly and a greater area must be peeled at the beginning and at the end of the opening operation than in the intermediate part of the opening operation, as will be explained more fully below.

OBJECT AND SUMMARY OF THE INVENTION

Accordingly, it is the object of this invention to provide an easy-opening closure for hermetic sealing of the open end of a packaging container and which overcomes the above discussed problems heretofore encountered with conventional double-seamed metal ends and with conventional film or foil lidding systems attached by bonding to the open end of the container and which provides a sealed container having seal integrity to allow a retort/sterilization process and reheating by microwave energy.

It is also an object of this invention to provide an easy-opening closure of the type discussed above wherein the force required to open the closure, after an initial starting of the opening operation, is generally consistent through the opening operation.

It has been found by this invention that the above object may be accomplished by providing an easy-opening closure for hermetic sealing of the open end of a packaging container which is circumferentially opened and which comprises generally the following.

An end member is provided of desired construction for being double-seamed to the open end of the packaging container, preferably a cylindrical container, and having an interior ledge portion defining a large central opening, preferably generally circular, to allow access therethrough to the interior of the container. A composite lidding member is provided which includes at least two polymer layers defining a predetermined peel strength at an interfacial plane thereof for controlled delamination of the two layers. The composite lidding member is of desired configuration, preferably circular, for covering the central opening and has a portion thereof overlapping the ledge portion and bonded to the ledge portion of the end member to define a predetermined bond strength greater than the peel strength of the two polymer layers of the composite lidding member.

The composite lidding member has a first notch of generally continuous ring-shaped configuration, preferably circular, corresponding to the desired opening to be produced in the closure after easy-opening thereof and cut into the bottom one of the polymer layers overlying the central opening and adjacent the ledge portion. The composite lidding member has a second notch of generally discontinuous ring-shaped configuration, preferably circular, and cut into the top one of the polymer layers and spaced radially inwardly from the first notch and defining a small unnotched portion between the ends thereof and defining with the first notch a ring member there between which is connected at the unnotched portion to a central portion of the lidding member overlying the opening in the end member.

With this construction, the force required to open the closure from the inside of the container when double-seamed to the container is greater than the force required to open the closure from the outside of the container. The closure is easily-opened circumferentially by upward pulling of the bonded overlapping portion of the composite lidding member to cause delamination and peeling of the portion of the top polymer layer from the bottom polymer layer bonded to the end member in an area between the first notch and an outside circumference of the lidding member and removal of the ring member between the first and second notches. This construction further provides, after an initial start up, a consistent opening force for peeling or controlled delamination of the two layers in the composite lidding member.

The bonding between the end member and the top polymer layer of the composite lidding member preferably comprises heat sealing. The first and second notches preferably extend completely through the respective bottom and top polymer layers. The end member preferably comprises either a formable polymeric material or a formable metallic material for adapting the end member to be double-seamed to the packaging container.

The composite lidding member may further include a tab extending from the ring member adjacent the unnotched portion for easy grasping to open the closure. The tab may comprise a separate member bonded to the top polymer layer and which defines a bonding strength greater than the peel strength of the two polymer layers so that the tab may be grasped and pulled upwardly to initiate delamination and peeling of the polymer layers. The composite lidding may further include short linear diverging notches in the top polymer layer which extend from the tab to the first and second notches forming the ring member to facilitate starting of the delamination of the top and bottom polymer layers. Alternatively, the tab member may comprise an integral extension of the composite lidding member and a third notch of desired configuration is cut in to the bottom one of the polymer layers to define the tab so that the tab may be grasped and pulled upwardly to initiate delamination and peeling of the polymer layers at the second notch.

BRIEF DESCRIPTION OF THE DRAWINGS

Some of the objects and advantages of this invention having been described above, other objects and advantages will appear in the Detailed Description Of The Invention to follow when taken in conjunction with the accompanying drawings, in which.

DETAILED DESCRIPTION OF PREFERRED EMBODIMENTS OF THE INVENTION

Figure 1:
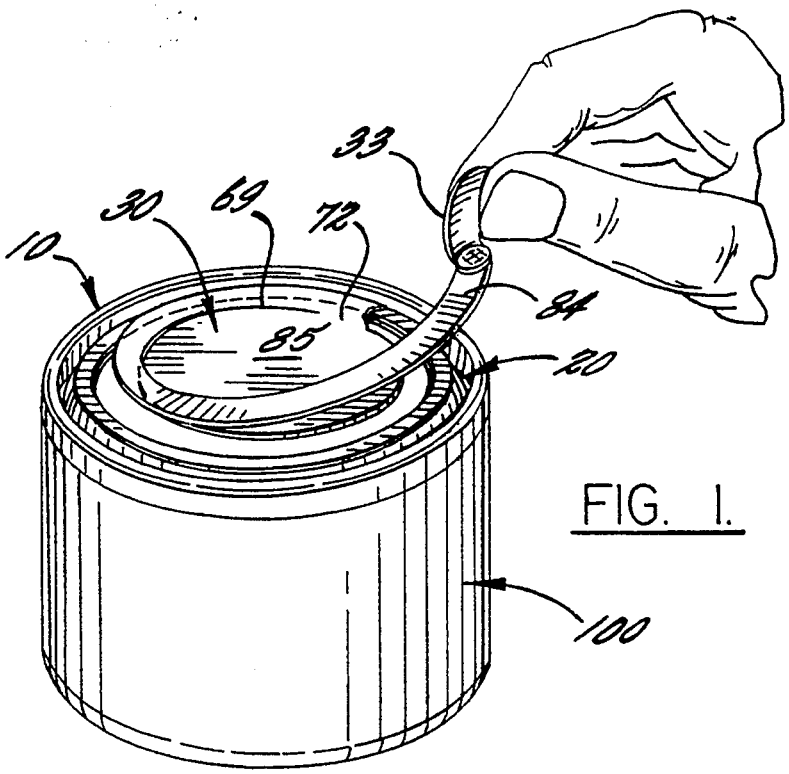
FIG. 1 is a perspective view of an easy-opening composite closure constructed in accordance with the present invention and which is double-seamed to one end of a packaging container for hermetic sealing thereof and further illustrating the closure being opened.
Figure 2:
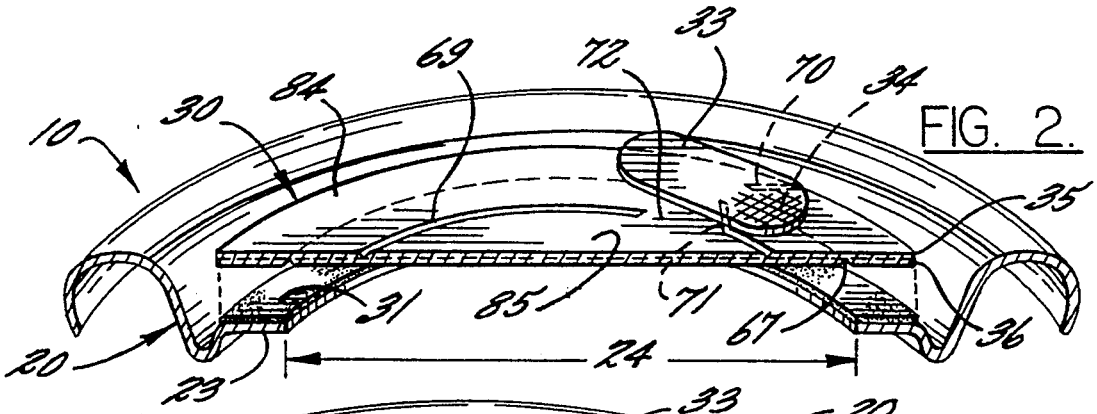
FIG. 2 is an enlarged exploded sectional view through an easy-opening composite closure of the type illustrated in FIG. 1 and prior to being double-seamed to the end of a packaging container.

Referring now to the drawings, there is illustrated in FIG. 1 an easy-opening closure, generally designated at 10, constructed in accordance with this invention and which has been double-seamed to the open end of a packaging container, generally designated at 100, for hermetic sealing thereof. The packaging container 100 may be any suitable container for food or other products and may be constructed of semi-rigid plastic, steel, aluminum or other types of material used conventionally and designed for the double-seaming thereto of closures of the type described. The packaging container 100 is usually generally cylindrical, but may be in the shape of a bowl, tray, etc. The bottom end of the packaging container 100 may be sealed by any desired conventional closure.

Figure 3:
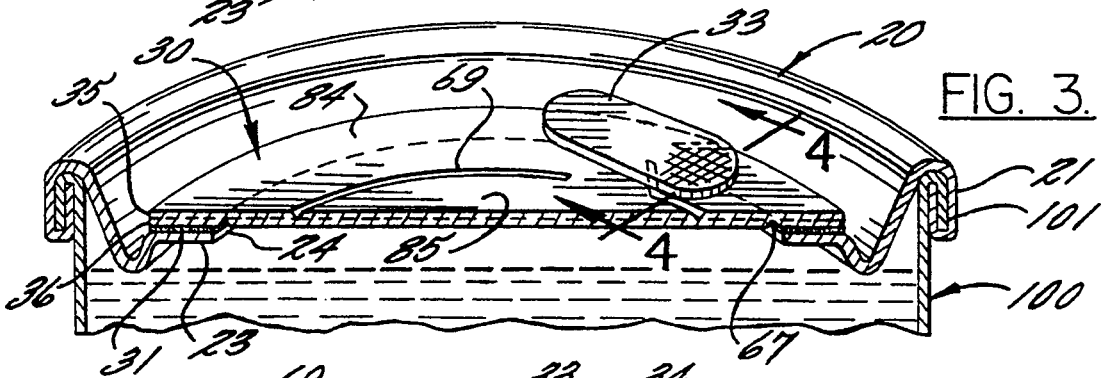
FIG. 3 is an enlarged partial sectional view taken generally through the easy-opening composite closure double-seamed to one end of the packaging container of FIG. 1 and prior to being opened.
Figure 4:
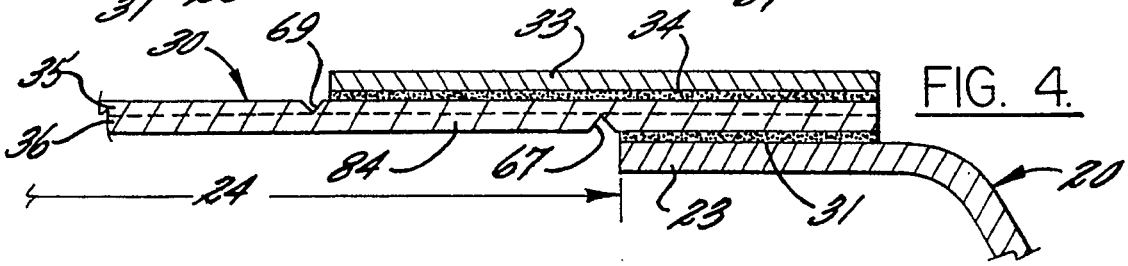
FIG. 4 is an enlarged partial sectional view taken generally along the line 4—4 of FIG. 3.
Figure 5:
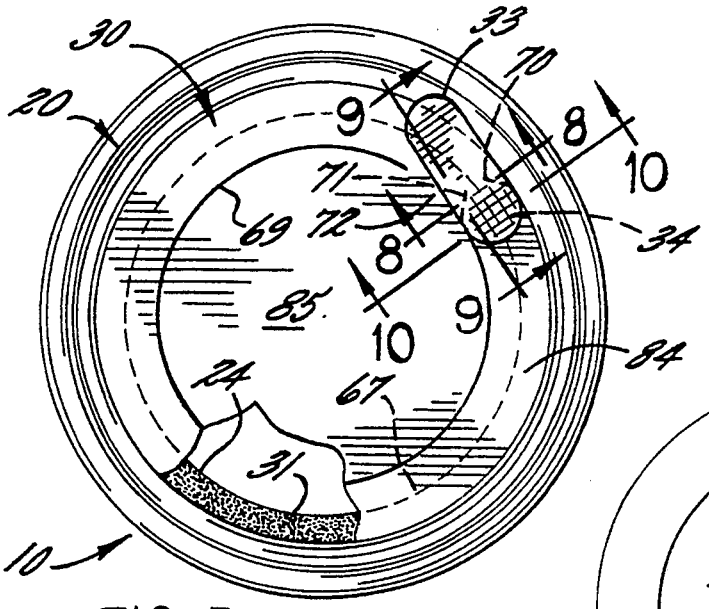
FIG. 5 is a top plan view, partially broken away, of the easy-opening composite closure which is double-seamed to one end of the packaging container of FIG. 1 and prior to being opened.

The easy-opening closure 10 of this invention includes an end member 20 of desired construction for being double-seamed in a conventional manner on conventional equipment to the open end of the container 100. Conventional double-seaming equipment utilizes a two-stepped rolling operation to form the end curl 21 of the end member 20 and the body flange 101 of the container 100 into a hermetic double-seal, as shown in FIG. 3. The composite end member 20 includes an interior ledge portion 23 which defines a large central opening 24, preferably generally circular, to allow access therethrough to the interior of the container 100.

The end member 20 could be constructed of a formable metal material, such as aluminum or steel foil. These metal foils are readily commercially available. Alternatively, the end member 20 could be constructed of a formable polymeric material demonstrating the ability to be cold-formed, thus making it suitable for use in existing end making equipment and double-seaming equipment. This polymeric material would be less expensive than the metallic material and could provide an all plastic closure 10 which is more suitable in microwave retort and reheating applications. These plastic materials which have the necessary characteristics of ductility, high tensile strength, high flexural modules, etc. to exhibit good performance as a formable material include acrylonitrile-butadiene-styrene (ABS), polyvinyl chloride (PVC), polycarbonate (PC) and other plastic compounds, alloys or blends having such characteristics.

The easy-opening closure 10 further includes a composite lidding member 30 of desired configuration, preferably circular, covering the central opening 24 of the end member 20 and having a portion overlapping the ledge portion 23 and bonded thereto, preferably by heating sealing 31, to define a predetermined bond strength. The composite lidding member 30 includes a multi-layer structure having at least two polymer layers 35, 36 defining a predetermined peel strength at an interfacial plane for controlled delamination of the two layers 35, 36. Only two such polymer layers 35, 36 are illustrated in the drawings, however, additional layers may be utilized to provide barrier properties, high temperature protection, etc. It is preferred that the bottom polymer layer 36 be of a type suitable for heat-seal bonding. Polymers suitable for use as these layers 35, 36 in the composite lidding member 30 include polyethylene, polypropylene, polyethylene/polypropylene blend, random copolymer polypropylene and high density polyethylene, etc.

As set forth above, heat sealing 31 of the end member 20 to the lidding member 30 and the bottom polymer layer 36 thereof defines a predetermined bond strength and this bond strength is greater than the peel strength of the two polymer layers 35, 36 of the composite lidding member 30. It has been found that a bond strength between the end member 20 and the bottom polymer layer 36 of the lidding member by the heat seal bond 31 could be in the range of three pounds to eight pounds and the peel strength for controlled delamination of the polymer layers 35, 36 could be in the range of 1.5 pounds to 4.5 pounds. The heat seal bond 31 between the end member 20 and the lidding member 30 in the ledge portion 23 thermally fuses the lidding member 30 to the end member 20 continuously around the periphery of the central opening 24. This heat seal bond 31 is preferably about 2 mm to 3 mm or larger in width.

The thus formed closure 10 would be double-seamed onto the open end of the filled packaging container 100 by a double-seaming operation, as described above. The contents within the packaging container 100 are thus hermetically sealed and protected from exposure to any contamination from outside air or organisms. The seal may be enhanced by the optional addition of a barrier polymer layer added to either or both the end member 20 or the composite lidding member 30. Easy-opening of the closure 10 is effected by taking advantage of the controlled delamination of the polymer layers 35, 36 of the lidding member 30 rather than using the heat seal bond 31 as a peeling area between the end member 20 and the lidding member 30.

For providing such easy-opening, the composite lidding member 30 includes a first notch 67 of generally continuous ring-shaped configuration, preferably circular, corresponding to the desired opening to be produced in the closure 10 after easy-opening thereof. The first notch 67 is cut into the bottom polymer layer at the periphery of the heat-seal area 31 to completely penetrate the bottom polymer layer 36 and intersect the interfacial plane of the two polymer layers 35, 36, but does not penetrate through the upper polymer layer 35 so as to allow controlled delamination of the two polymer layers 35, 36 along the notch 67. There is further provided a second notch 69 of generally discontinuous ring-shaped configuration, preferably circular, and cut into the top one of said polymer layers 35 to penetrate through the top polymer 35 and intersect the interfacial plane of the two polymer layers 35, 36, but does not penetrate through the lower polymer layer 36 to provide controlled delamination of the two polymer layers 35, 36 along such notch 69. The second notch 69 is spaced radially inwardly from the first notch, preferably about 3 to 7 mm, and defines a small unnotched portion 72 in the form of a discontinuity or gap, preferably of about 2 to 5 mm, between the ends of the second notch 69. The second notch 69 defines with the first notch 67 a ring member or circumferentially peelable strip 84 therebetween which is connected at the unnotched portion 72 with a central portion 85 of the lidding member 30 overlying the opening 24 in the end member 20.

The lidding member 30 further includes a tab 33 extending from the ring member 84 adjacent the unnotched portion 72 connecting the ring member 84 to the central portion 85 of the lidding member 30 for grasping of the tab portion to open the closure 10. The tab portion 33 may comprise a separate member bonded to the top polymer layer 35, by a heat sealing 34, which define a bond strength greater than the peel strength of the two polymer layer 35, 36 of the composite lidding member 30, so that the tab 33 may be grasp and pulled upwardly to initiate delamination and peeling of the polymer layers 35, 36.

Figure 6:
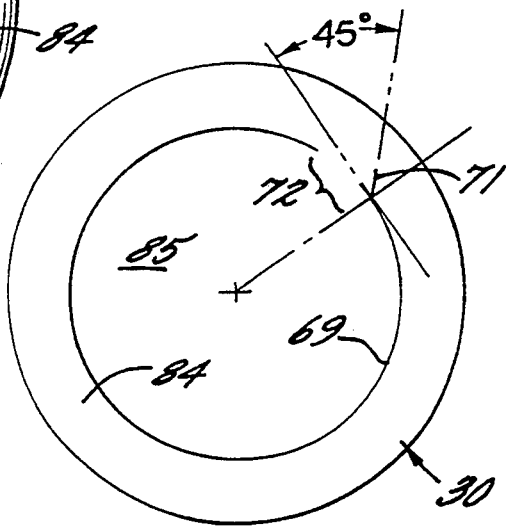
FIG. 6 is a schematic top plan view of the composite lidding member showing a notch cut into the top one of the two polymer layers thereof and the angular relationship of one of two short diverging notches cut into the top polymer layer.
Figure 7:
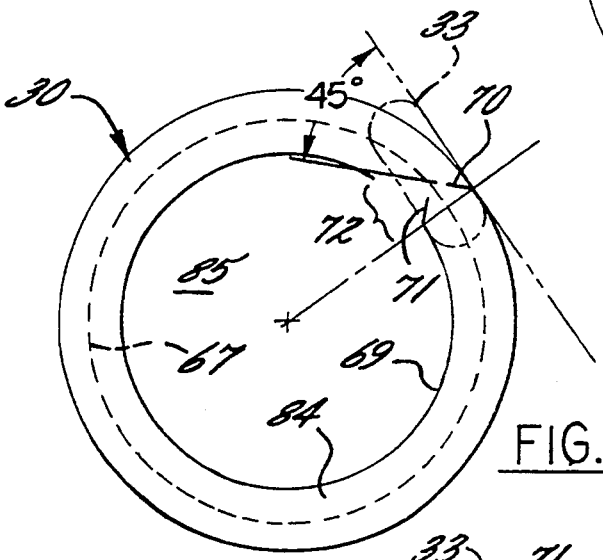
FIG. 7 is a schematic top plan view, like FIG. 6, of the composite lidding member further illustrating in phantom lines a notch cut into the bottom one of the polymer layers and the angular relationship of the other of the short diverging notches cut in the top polymer layer.
Figure 8:
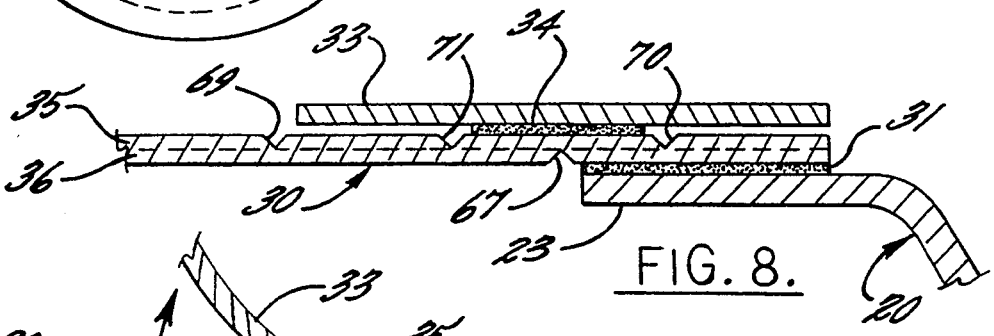
FIG. 8 is an enlarged partial sectional view taken generally along the line 8—8 of FIG. 5.
Figure 9:
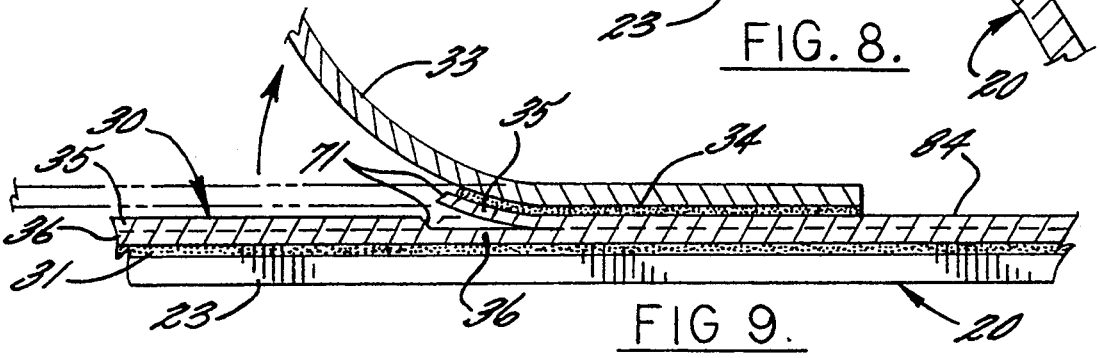
FIG. 9 is an enlarged partial sectional view taken generally along the line 9—9 of FIG. 5 and illustrating the beginning of the opening of the easy-opening closure.
Figure 10:
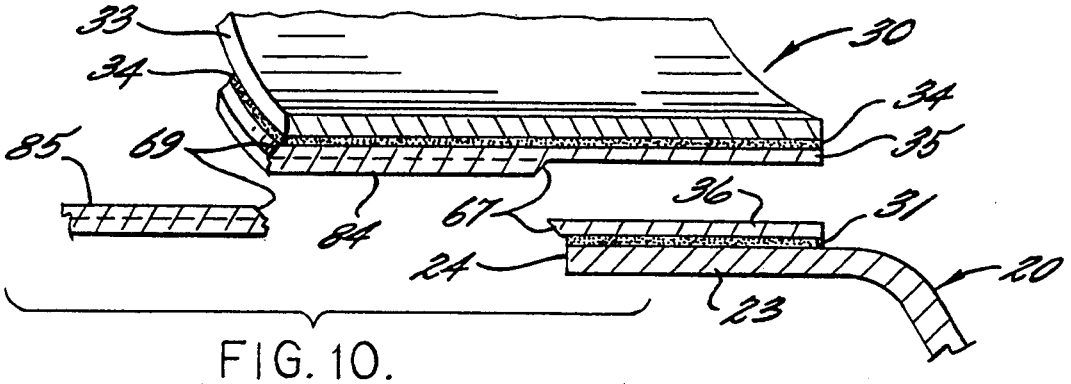
FIG. 10 is an enlarged partial sectional view taken generally along the line 10—10 and after the opening has begun of the easy-opening closure.
Figure 11:
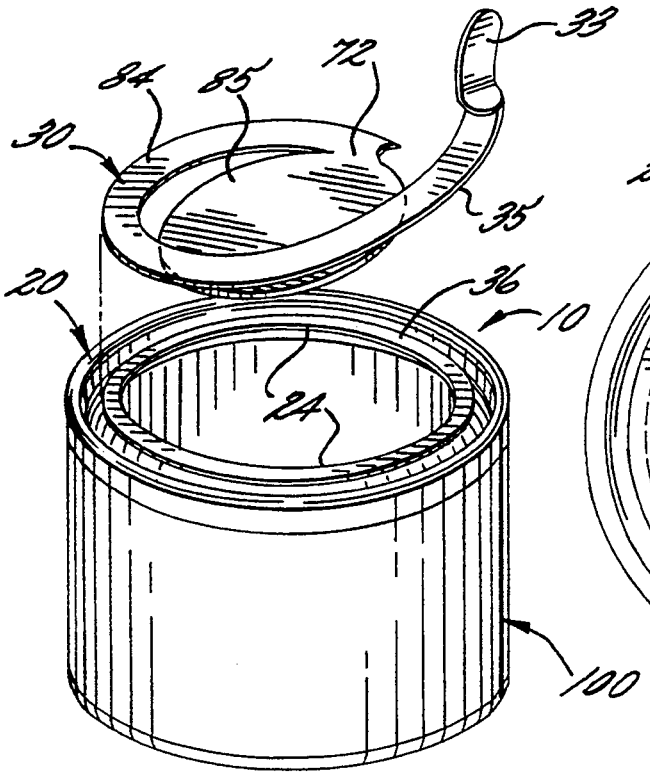
FIG. 11 is a perspective view, like FIG. 1, of the easy-opening composite closure constructed in accordance with the present invention and which is double-seamed to one end of a packaging container for hermetic sealing thereof and further illustrating the closure after it has been fully opened.

The composite lidding member 30 further includes short linear diverging notches 70, 71, as shown in FIGS. 6 and 7, each of which forms approximately a 45 degree angle with a tangent to the outside of the lidding member 30 and a tangent to the circular notch 69. These notches 70, 71 are cut through the top polymer layer 35 on either side of the heat seal portion 34 connecting the tab to the top polymer layer 35 and the notch 71 connects with the notch 69 so that upon lifting of the tab 33, a short portion of the top polymer layer 35 between the inward ends of the diverging notches 70, 71 is torn and then the polymer layers 35, 36 are delaminated between the first and second notches 67, 69 so as to cause delamination and circumferential peeling of the portion of the top polymer layer 35 from the bottom polymer layer 36 heat sealed at 31 to the end member 20 and between the notch 67 and the outside circumference of the lidding member 30. This delamination continues in a circular direction and removes the ring shaped member 84 between the notches 67 and 69 of both polymer layers 35, 36 until the unnotched portion 72 is reached which allows the ring shaped member 84 and the central portion 85 to be totally removed from the closure 10, as shown in FIG. 11.

Figure 12:
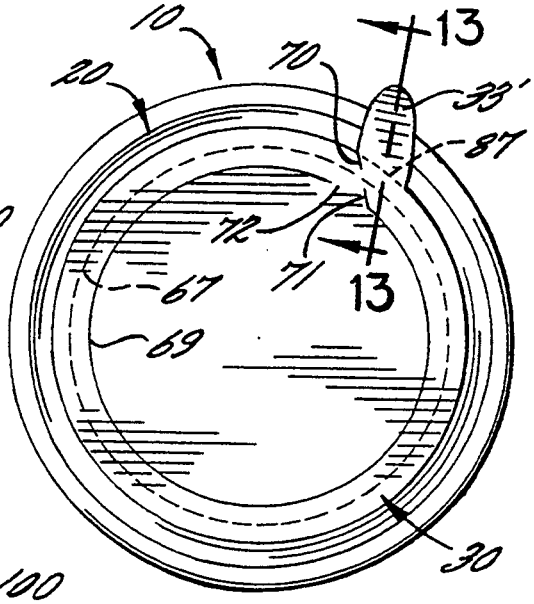
FIG. 12 is a top plan view, of an easy-opening composite closure double-seamed to the end of a packaging container and illustrating an alternative embodiment of a tab member.
Figure 13:
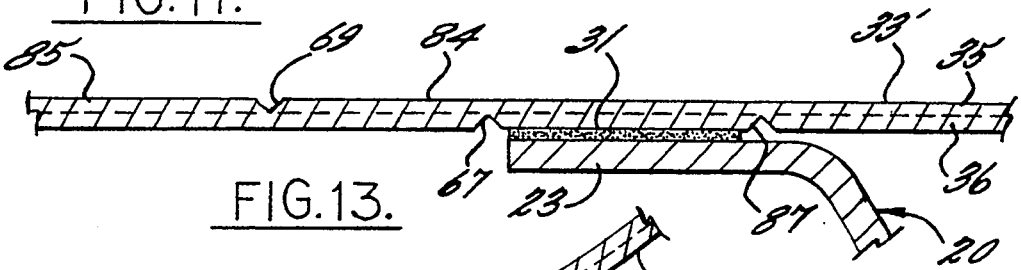
FIG. 13 is an enlarged, partial sectional view taken generally along the line 13—13 of FIG. 12.
Figure 14:
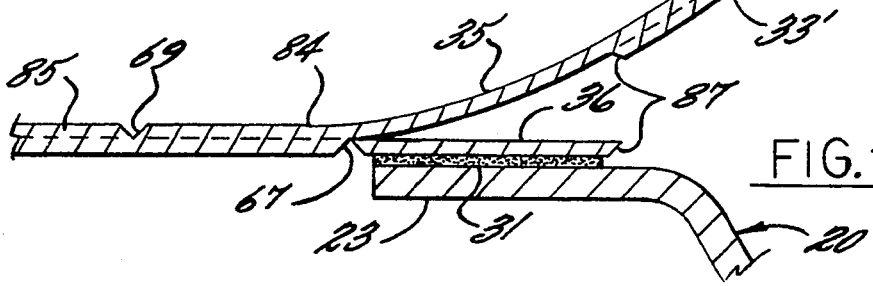
FIG. 14 is an enlarged sectional view, like FIG. 13, and illustrating the beginning of the opening of the easy-opening closure.

Alternatively, as shown in FIGS. 12–14, the tab 33 may be formed as an integral extension of the composite lidding member 30. In this embodiment, the notches 70 and 71, instead of being diverging, extend linearly towards each other with a slight gap inbetween. Also, a further short arcuate notch 87 is formed in the bottom polymer layer 36 at the tab portion 33 so as to define the tab portion and to allow the tab portion 33 to be pulled upwardly to start peeling and delamination of the top and bottom polymer layers 35, 36, as shown in FIGS. 13 and 14.

Figure 15:
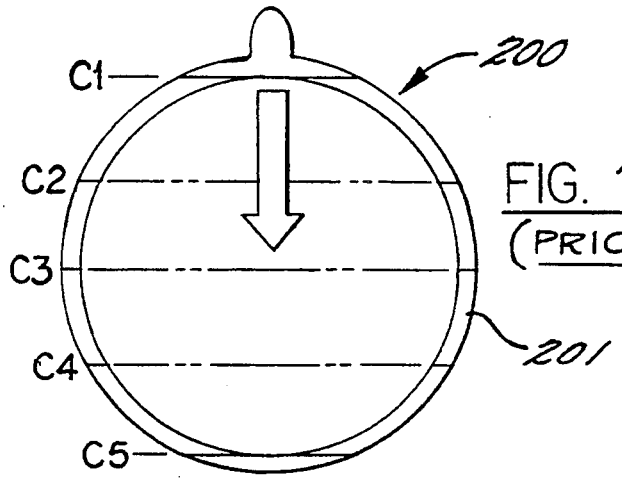
FIG. 15 is a schematic top plan view illustrating the zones of opening forces required for linearly opening a prior design of easy-opened closure constructed in accordance with the above mentioned pending U.S. patent application.
Figure 16:
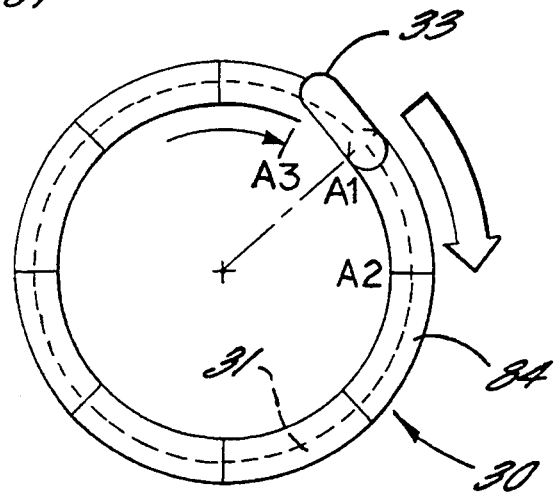
FIG. 16 is a view, like FIG. 15, illustrating the zones of opening forces required for circumferentially opening the easy-opening closure of the present invention.
Figure 17:
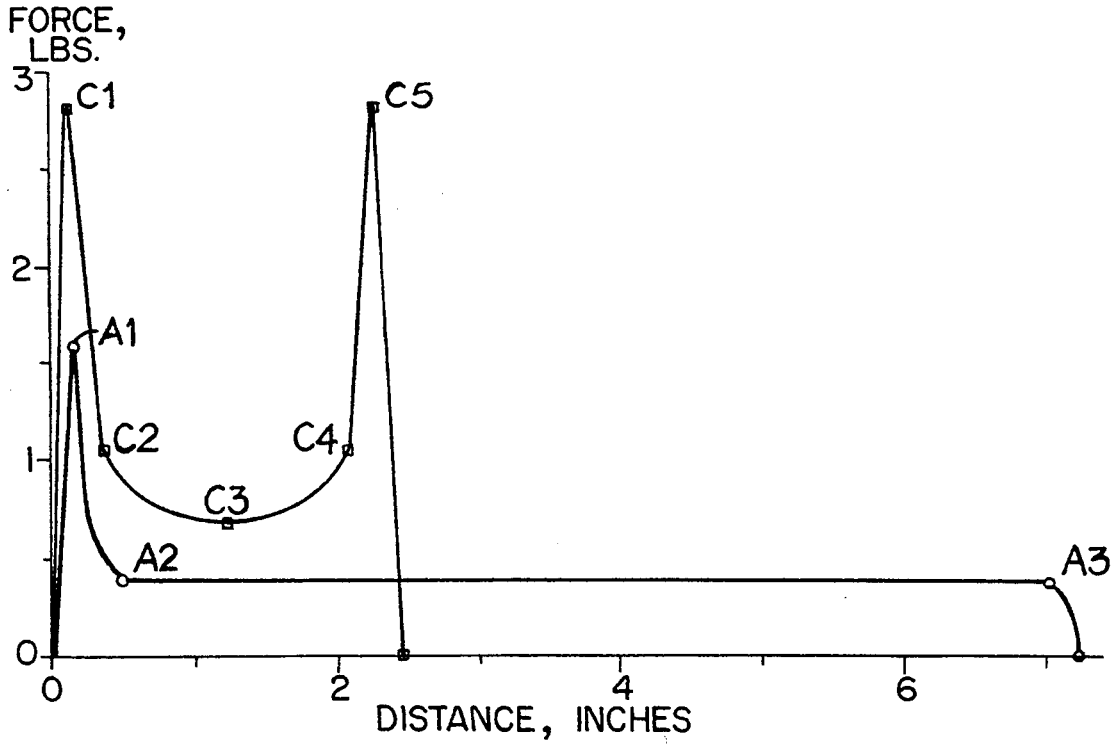
FIG. 17 is a graph of the opening forces required in the zones to open the closures of FIGS. 15 and 16.

Referring now to FIGS. 15–17, FIG. 15 schematically illustrates a composite lidding member 200 heat sealed around the periphery thereof at 201 to an end member in accordance with the construction of assignee's copending U.S. Patent application Ser. No. 07/684,161 (discussed above). In this prior design, the polymer layers of the composite lidding member are peeled or delaminated in a linear direction by pulling the tab portion in the direction of the arrow shown in FIG. 15. This creates a greater area or peel resistance at the beginning and at the end in the zones indicated C-1 and C-5. The zones C-2 and C-4 require the next greatest force and the zone C-1 has the least sealing area and thereby requires the least force. Accordingly, the force required to open this easy-opening closure varies from zones C-1 to C-2 to C-3 to C-4 to C-5 in accordance with the graph shown in FIG. 17.

In opposition to this, the circumferential peeling for delamination of the composite lidding member 10 of the closure construction of the present invention is shown in FIG. 16. After the initial force required to break through the polymer layers to start opening which is indicated at zone A-1, the opening force becomes constant at zone A-2 and extends and continues to the zone A-3 wherein it falls off to zero as the closure is completely opened, as shown in the graph of FIG. 17.

Thus, this invention has provided an easy-opening closure for hermetic sealing of the open end of a packaging container and which overcomes problems heretofore encountered with conventional double-seamed metal ends and with conventional film or foil lidding systems. Use of the easy-opening closure of this invention on a packaging container provides seal integrity to allow retort/sterilization processes and reheating by microwave energy. Additionally, the force required to circumferentially open the closure of this invention, after an initial starting of the opening operation, is generally consistent throughout the opening operation and, thus, overcomes inconsistent opening force problems associated with assignee's own prior design.

Although specific and descriptive terms have been utilized in the above description of the preferred embodiments of this invention, these terms and descriptions are used in a generic and descriptive sense only and not for purposes of limitation. The scope of the invention in the following claims.

What is claimed is:

1. An easy-opening closure for hermetic sealing of the open end of a packaging container and comprising:

an end member of desired construction for being double-seamed to the open end of the container and having an interior ledge portion defining a large central opening to allow access therethrough to the interior of the container, a composite lidding member including at least two polymer layers defining a predetermined peel strength at an interfacial plane thereof for controlled delamination of said two layers, said composite lidding member being of desired configuration for covering said central opening and having a portion overlapping said ledge portion and bonded to said ledge portion of said end member to define a predetermined bond strength greater than said peel strength of said two polymer layers of said composite lidding member;

said composite lidding member having a first notch of generally continuous ring-shaped configuration corresponding to the desired opening to be produced in said closure after easy-opening thereof and cut into the bottom one of said polymer layers overlying said central opening and adjacent said ledge portion, and a second notch of generally discontinuous ring-shaped configuration and cut into the top one of said polymer layers and spaced radially inwardly from said first notch and defining a small unnotched portion between ends thereof and defining with said first notch a ring member therebetween which is connected at said unnotched portion to a central portion of said lidding member overlying said opening in said end member; and whereby, the force required to open said closure from the inside of the container when double-seamed to the container is greater than the force required to open said closure from the outside of the container and wherein said closure is easily-opened circumferentially by upwardly pulling of said bonded overlapping portion of said composite lidding member to cause delamination and peeling of the portion of said top polymer layer from said bottom layer bonded to said end member in an area between said first notch and an outside circumference of said lidding member and removal of said ring member between said first and second notches.

2. An easy-opening closure for hermetic sealing of the open end of a packaging container and comprising:

an end member of desired construction for being double-seamed to the open end of a generally cylindrical container and having an interior ledge portion defining a large generally circular central opening to allow access therethrough to the interior of the container, a composite lidding member including at least two polymer layers defining a predetermined peel strength at an interfacial plane thereof for controlled delamination of said two layers, said composite lidding member being of generally circular configuration for covering said central opening and having a portion overlapping said ledge portion and bonded to said ledge portion of said end member to define a predetermined bond strength greater than said peel strength of said two polymer layers of said composite lidding member;

said composite lidding member having a first notch of generally continuous circular configuration corresponding to the desired opening to be produced in said closure after easy-opening thereof and cut into the bottom one of said polymer layers overlying said central opening and adjacent said ledge portion, and a second notch of generally discontinuous circular configuration and cut into the top one of said polymer layers and spaced radially inwardly from said first notch and defining a small unnotched portion between ends thereof and defining with said first notch a circular-shaped ring member therebetween which is connected at said unnotched portion to a central portion of said lidding member overlying said opening in said end member; and whereby, the force required to open said closure from the inside of the container when double-seamed to the container is greater than the force required to open said closure from the outside of the container and wherein said closure is easily-opened circumferentially by upwardly pulling of said bonded overlapping portion of said composite lidding member to cause delamination and peeling of the portion of said top polymer layer from said bottom layer bonded to said end member in an area between said first notch and an outside circumference of said lidding member and removal of said ring member between said first and second notches.

3. An easy-opening closure, as set forth in claim 1 or 2, wherein said first and second notches extend completely through said respective bottom and top polymer layers.

4. An easy-opening closure, as set forth in claim 1 or 2, wherein the bonding between said end member and said top polymer layer of said composite lidding member comprises heat sealing.

5. An easy-opening closure, as set forth in claim 1 or 2, wherein said composite lidding member further includes a tab extending from said ring member adjacent said unnotched portion for easy grasping to open said closure.

6. An easy-opening closure, as set forth in claim 5, wherein said tab comprises a separate member bonded to said top polymer layer and defining a bonding strength greater than said peel strength of said two polymer layers so that said tab may be grasped and pulled upwardly to initiate delamination and peeling of said polymer layers.

7. An easy-opening closure, as set forth in claim 6, wherein said composite lidding further includes short diverging notches in said top polymer layer and extending from said tab to said first and second notches forming said ring member to facilitate the starting of the delamination of said top and bottom polymer layers.

8. An easy-opening closure, as set forth in claim 5, wherein said tab comprises an integral extension of said composite lidding member and wherein a notch of desired configuration is cut into the bottom one of said polymer layers to define said tab so that said tab may be grasped and pulled upwardly to initiate delamination and peeling of said polymer layers at said second notch.

9. An easy-opening closure, as set forth in claim 1 or 2, wherein said end member comprises a formable polymeric material.

10. An easy-opening closure, as set forth in claim 1 or 2, wherein said end member comprises a formable metallic material.

* * * * *